United States Patent [19]

Foster

[11] Patent Number: 4,704,742

[45] Date of Patent: Nov. 10, 1987

[54] WRITING SHIELD

[76] Inventor: Rudolph Foster, 527 Oak Street, Syracuse, N.Y. 13203

[21] Appl. No.: 859,509

[22] Filed: May 5, 1986

[51] Int. Cl.[4] ..... A41D 19/00

[52] U.S. Cl. ..... 2/21; 2/163

[58] Field of Search ..... 2/20, 21, 161, 163; 34/95.2; 15/443, 227

[56] References Cited

U.S. PATENT DOCUMENTS

| | | | |
|---|---|---|---|
| 310,257 | 1/1885 | Cowan | 34/95.2 |
| 393,359 | 11/1888 | Cole | 34/95.2 |
| 1,247,183 | 11/1917 | Usterud | 2/163 |
| 1,527,503 | 2/1925 | Anderson | 34/95.2 |
| 3,593,339 | 7/1971 | Main et al. | 2/21 X |
| 3,735,442 | 5/1973 | Lukas | 2/20 X |
| 3,787,898 | 1/1974 | Walker | 2/163 |

*Primary Examiner*—Louis K. Rimrodt
*Attorney, Agent, or Firm*—Bruns and Wall

[57] ABSTRACT

A writing shield having apparatus for preventing a document being written upon from being soiled by the hand of a writer who might work in a dirty environment. The shield includes a J-shaped body that conforms to the back or heel of the hand and the outside of the little finger when the hand is in a writing position. A ring like member is secured to the body that can be slipped over the little finger to removably attach the shield to the hand. The body is contoured so that it will glide over the document in one point contact thereagainst during the writing process.

1 Claim, 4 Drawing Figures

WRITING SHIELD

BACKGROUND OF THE INVENTION

This invention relates to a hand engagable apparatus for preventing a document from becoming soiled when written by a person having dirty hands due to the nature of his or her work.

Many people, such as auto mechanics, are constantly working in an environment where their hands become contaminated with sweat, dirt, grease and other substances that can be easily transferred to paper documents. During the course of their work, however, these people are forced to fill out different types of reports or prepare invoices and other similar statements. The progress of the work often times cannot be interrupted to clean ones hands each time a document is prepared. As a consequence many of these documents become soiled with dirt or grease which is transferred from the preparer's hand. On occasion the information on the document is rendered unreadable by the resulting soil. Presenting dirt covered documents to a customer can also have a negative effect on business relations. Although a protective covering such as a glove can be worn on the writing hand when preparing documents, gloves are usually difficult to get on and off. Consequently, a good deal of time is wasted in preparing the document. The glove, just as the hand, can become dirty with time and use. The collected dirt will transfer from the glove to the document again causing soiling.

SUMMARY OF THE INVENTION

It is therefore an object of the present invention to provide a hand engageable device that can be worn by a mechanic or the like to prevent documents that he writes upon from becoming soiled.

A further object of the present invention is to provide a hand engageable device that can be easily put on or taken off by an auto mechanic or the like to protect documents that the mechanic is forced to prepare during the course of his work.

Another object of the invention is to prevent documents from becoming soiled when written upon by a person whose hands become dirt covered due to the nature of his or her work.

Yet another object of the present invention is to provide a simple and inexpensive device that can be worn by a writer upon the writing hand which prevents soil from being transferred from the hand to the document being written upon.

A still further object of the invention is to provide a protective device that can be hand worn to prevent soils from being transferred from the hand to a document that is being written upon and which can glide easily over the document to aid and enhance the writing process.

BRIEF DESCRIPTION OF THE DRAWINGS

For a better understanding of these and other objects of the present invention reference is had to the following detailed description of the invention which is to be read in conjunction with the accompanying drawings wherein.

DESCRIPTION OF THE INVENTION

Figure 1:
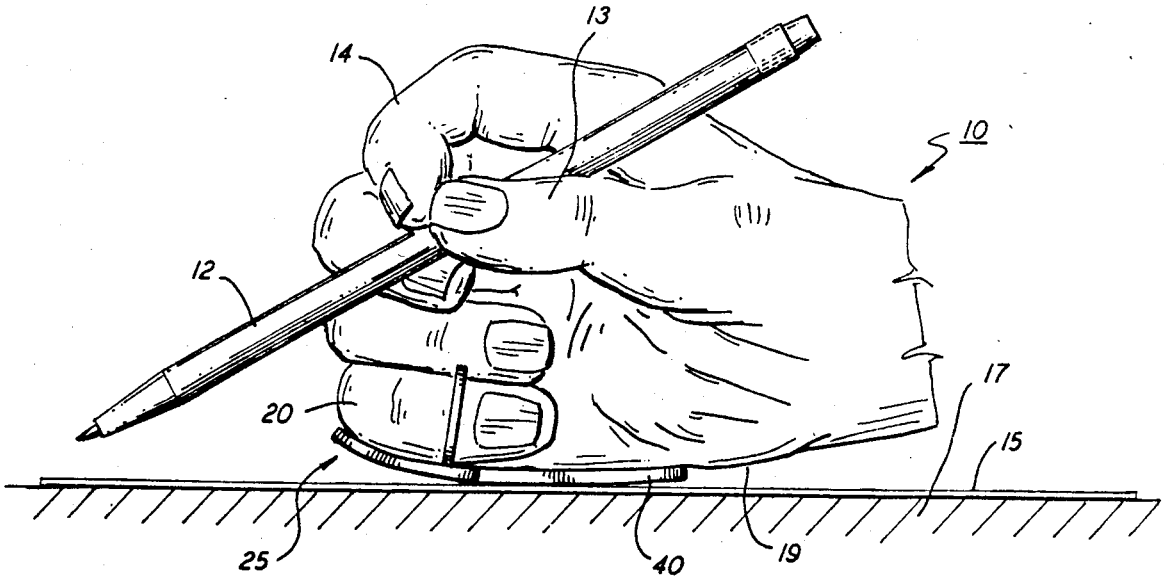
FIG. 1 is a perspective view of a hand upon which is worn the apparatus of the present invention.

Turning now to the drawings, there is illustrated in FIG. 1 a human hand 10 holding a writing implement 12 between the thumb 13 and forefinger 14 of the hand in a normal writing position. The writing implement is directed downwardly toward a document 15 that is resting upon a support surface 17 such as a table or work bench. Typically, the document will be a paper material that can easily attract and absorb all forms of dirt and grease. As a consequence, any dirt or grease on the hand of the writer will be transferred to the paper thus producing unwanted soiling of the document.

As illustrated in FIG. 1, when the hand is held in a normal writing position, the side 19 of the hand opposite the thumb and the outside surface of the "pinky" or little finger 20 rest in contact against the document 15. The remainder of the hand, however, is normally held above the document well out of contact therewith. It is these contacting surfaces therefore that are most likely to transfer soil producing substances to the document as the hand moves there across during the writing process. These hand and finger contact surfaces of greatest concern are shielded from the document by the apparatus of the present invention which is generally referenced 25.

Figure 2:
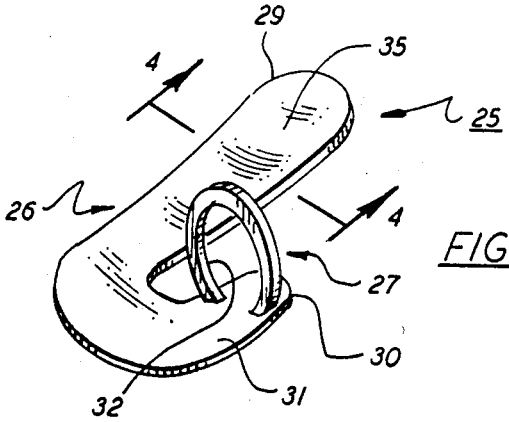
FIG. 2 is also a perspective view further illustrating the apparatus of the present invention.
Figure 3:
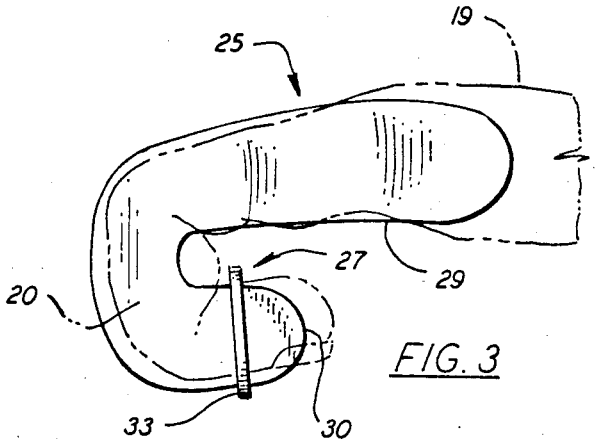
FIG. 3 is an enlarged top plan view of the apparatus shown in FIG. 2
Figure 4:
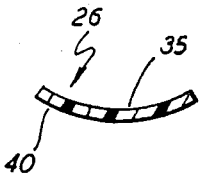
FIG. 4 is a section taken along lines 4—4 in FIG. 3.

Turning now to FIGS. 2–4, apparatus 25 of the invention, which shall be herein referred to as a writing shield, consists of a J-shaped body 26 and an annular ring 27 secured by any suitable means to the body. The body further includes an elongated leg 29 and a foreshortened leg 30. The annular ring 27 is secured to the midsection of the foreshortened leg and protrudes upwardly from the top surface 31 thereof so that the ring is generally perpendicular with the plane of the member.

As shown in FIG. 3 the opening 32 in the ring is large enough to permit the little finger of the wearer to pass therethrough to at least the first finger joint. The finger is passed through the backside 33 of the ring as shown so that when the finger is bent into a writing position, the top surface 35 of the elongated leg is situated along the outside of the little finger 20 and the side of the hand opposite the thumb. This side of the hand shall be herein referred to as the heel of the hand and identified by the number 19.

The writing shield body 26 is preferably formed of a single piece of material which can be moldable plastic such as tetrafluorethylene (TFE). The body is generally arcuate shaped so that the bottom surface 40 of the shield is convex in form. Accordingly, when in use, the shield will maintain one point contact against the document and thus glide easily over the contact surface of the document. In practice, besides protecting the document from soils the shield also aids in the writing process. Unlike many more porous materials, the hard plastic body of the shield is generally impervious to dirt and grease. If the shield does come in contact with a soil producing substance, it can be easily cleaned using a paper towel or the like.

Preferably, the body and the ring are molded together to produce a one piece shield of high strength construction. Again TFE can be used as a molding material or any other similar type plastic that is relatively dirt resistant and which has a low coefficient of friction so that the shield will glide or slide easily over the document being written upon.

While this invention has been disclosed with specific reference to the details as set forth above, it is not intended to be limited to the specific structure and the invention is intended to cover any modifications or changes that may come within the scope of the following claims.

I claim:

1. A pocket size writing shield for use by a writer to prevent soil inducing materials from being transferred from the hand of the writer onto a document, that includes a J-shaped member having an elongated leg for covering the heel of the writer's hand that is joined to a parallel shorter leg for covering the outer side of the writer's little finger when the hand is in a writing position, a ring mounted on the back of the shorter leg for engaging the little finger and holding the rigid member snuggly against the little finger and the heel of the hand, said member and said ring being formed of a single piece of non-porous plastic having a low coefficient of friction, the front surface of each leg being convex in form so that the rigid member slides easily over the document when it is being written upon.

* * * * *